US009558900B2

(12) United States Patent
Pearce et al.

(10) Patent No.: US 9,558,900 B2
(45) Date of Patent: Jan. 31, 2017

(54) VACUUM ASSISTED ELECTRICAL DISCONNECT WITH DYNAMIC SHIELD

(71) Applicant: EATON CORPORATION, Cleveland, OH (US)

(72) Inventors: Michael Davis Pearce, Plum Branch, SC (US); Bryan Richard Benson, Chappells, SC (US); Melvin Lavern Hughes, Winterville, GA (US); Timothy Gordon Robirds, Greenwood, SC (US); Michael Howard Abrahamsen, Middle River, MD (US)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 14/559,291

(22) Filed: Dec. 3, 2014

(65) Prior Publication Data

US 2016/0163484 A1 Jun. 9, 2016

(51) Int. Cl.
*H01H 33/662* (2006.01)
*H01H 33/664* (2006.01)
*H01H 33/66* (2006.01)

(52) U.S. Cl.
CPC ..... *H01H 33/66207* (2013.01); *H01H 33/664* (2013.01); *H01H 33/6606* (2013.01);
(Continued)

(58) Field of Classification Search
CPC ..... H01H 2033/6623; H01H 2033/66284; H01H 2033/66276; H01H 33/662; H01H 33/66207; H01H 33/66261; H01H 33/6606; H01H 33/664
(Continued)

(56) References Cited

U.S. PATENT DOCUMENTS 3,955,167 A * 5/1976 Kumbera ..... H01H 85/047 337/188
4,083,028 A * 4/1978 Haubein ..... H01H 85/46 337/144

(Continued)

FOREIGN PATENT DOCUMENTS

CN 201000851 * 1/2008 ..... H01H 33/00
DE 241 809 A1 12/1986
JP 2003 281981 A 10/2003

OTHER PUBLICATIONS

Machine translation of CN201000851 (Orig. doc. published Jan. 2, 2008).*

(Continued)

*Primary Examiner* — Renee S Luebke
*Assistant Examiner* — William Bolton
(74) *Attorney, Agent, or Firm* — Eckert Seamans; Stephen Bucchianeri; Philip Levy

(57) ABSTRACT

An electrical disconnect includes a housing having a recess defined therein extending from an opening toward a base. The disconnect also includes a vacuum envelope defined within the housing near the base; a fixed contact assembly including a fixed contact structured to be in electrical communication with a voltage source disposed partially within the vacuum envelope; and a movable contact assembly including a movable contact having a first end disposed within the vacuum envelope and a second end disposed in the recess near the base and movable between a closed position in electrical contact with the fixed contact and an open position spaced apart from the fixed contact a separation distance. The housing includes a dynamic shield electrically connected to the movable contact, the dynamic shield being disposed about the recess within the housing and extending from the base toward the opening thereof.

19 Claims, 3 Drawing Sheets

(52) U.S. Cl.
CPC ..... *H01H 33/66261* (2013.01); *H01H 2033/6623* (2013.01); *H01H 2033/66284* (2013.01)

(58) Field of Classification Search
USPC ... 218/10, 118, 134, 136, 138, 139; 200/400
See application file for complete search history.

(56) References Cited

U.S. PATENT DOCUMENTS

| | | | | |
|---|---|---|---|---|
| 4,260,864 | A * | 4/1981 | Wayland | H01H 33/6644 218/129 |
| 4,618,749 | A | 10/1986 | Boehme et al. | |
| 5,321,221 | A | 6/1994 | Rozier | |
| 5,530,417 | A * | 6/1996 | Hohider | H01H 37/765 337/408 |
| 6,888,086 | B2 * | 5/2005 | Daharsh | H01C 7/12 218/155 |
| 2002/0066655 | A1 * | 6/2002 | Theaudiere | H01H 9/104 200/47 |
| 2004/0016721 | A1 * | 1/2004 | Traska | H01H 33/24 218/118 |
| 2005/0082260 | A1 * | 4/2005 | Martin | H01H 33/027 218/118 |
| 2012/0049995 | A1 * | 3/2012 | Murray | H01H 75/06 337/2 |

OTHER PUBLICATIONS

European Patent Office, "International Search Report and Written Opinion", corresponding International Appl. No. PCT/US2015/056332, Jan. 8, 2016, 11 pp.

* cited by examiner

VACUUM ASSISTED ELECTRICAL DISCONNECT WITH DYNAMIC SHIELD

BACKGROUND

Field

The disclosed concept pertains generally to electrical disconnects for interrupting or breaking an electrical connection. More particularly, the disclosed concept pertains to electrical disconnects related to medium voltage auxiliary devices.

Background Information

In an electric power system, switchgear is the combination of electrical disconnect switches, fuses or circuit breakers used to control, protect and isolate electrical equipment. Switchgear is used both to de-energize equipment to allow work to be done and to clear faults downstream. This type of equipment is directly linked to the reliability of the electricity supply.

Typically, switchgear in substations are located on both the high-voltage and low-voltage side of large power transformers. The switchgear on the low-voltage side of the transformers may be located in a building, with medium-voltage circuit breakers for distribution circuits, along with metering, control, and protection equipment. Switchgear commonly includes medium voltage disconnects for electrically connecting (and disconnecting) auxiliary devices (e.g., without limitation, voltage transformers, control power transformers) to a main power feed. Such disconnects include separable contacts which are movable between a closed position, in which the contacts are electrically engaged and thus current is provided to the auxiliary device, and an open position in which the contacts are spaced a suitable separation distance apart, thus isolating the auxiliary device. Movement of the contacts is typically carried out by a racking mechanism which moves one of the contacts a required separation distance from the other fixed contact. In known arrangements, the contacts may require separation distances in the range of about five to twenty inches (depending on the voltage) in order to safely separate the contacts and avoid partial discharge and arcflash. Such generally large separation distances, as well as the racking mechanism(s) required to move the contact such distances, require the use of generally large housings which thus limit the quantity of such arrangements which may be used in a particular facility.

There is thus room for improvement in electrical disconnects, and particularly in electrical disconnects for use in electrically connecting an auxiliary device to a medium voltage power source.

SUMMARY

These needs and others are met by embodiments of the disclosed concept which are directed to an electrical disconnect. The electrical disconnect comprising: a housing having a first end and an opposite second end, the housing including a recess defined therein extending from an opening disposed at or about the second end of the housing toward a base defined near the first end of the housing; a vacuum envelope defined within the housing about the first end; a fixed contact assembly including a fixed contact disposed partially within the vacuum envelope, the fixed contact assembly structured to be in electrical communication with a voltage source; and a movable contact assembly including a movable contact having a first end disposed within the vacuum envelope and an opposite second end disposed in the recess near the base thereof, the movable contact being movable between a closed position in electrical contact with the fixed contact and an open position spaced apart from the fixed contact a separation distance, wherein the housing comprises a dynamic shield electrically connected to the movable contact, the dynamic shield being disposed about the recess within the housing and extending from the base toward the opening thereof.

The separation distance may be equal to or less than one inch.

The housing may be formed from an insulating material. The insulating material comprises an epoxy material.

The dynamic shield may comprise a conductive mesh material disposed about the recess.

The housing may further comprise a number of fins extending from the second end of the housing about the opening of the recess.

The housing may further comprise an outward extending flange, the flange being structured to couple the housing to a panel member.

The housing may further include a ground shield disposed on or near the outer periphery thereof.

The ground shield may comprise a conductive coating disposed on the outer surface of the housing.

The movable contact assembly may comprise a current limiting fuse electrically connected to the second end of the movable contact.

The current limiting fuse may be electrically coupled to the second end of the movable contact via a fuse contact which is biased outward from the current limiting fuse and toward the second end by a contact pressure spring.

Such needs and others are also met by embodiments of the disclosed concept which are directed to a system comprising: a voltage source; an electrical device; and an electrical disconnect as described herein.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the term "about" shall mean at or near a further specified location.

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

As employed herein, the statement that two or more parts are "electrically connected" shall mean that the parts are disposed in electrical contact with each other either directly or through one or more intermediate parts such that a flow of current may pass from one part to the other.

As employed herein, the term "vacuum envelope" means an envelope employing a partial vacuum therein.

As employed herein, the term "partial vacuum" means a space (e.g., within a vacuum envelope) partially exhausted (e.g., to the highest degree practicable; to a relatively high degree; to a degree suitable for use in a vacuum switching apparatus application) by a suitable mechanism (e.g., without limitation, an air pump; a vacuum furnace).

Figure 1:
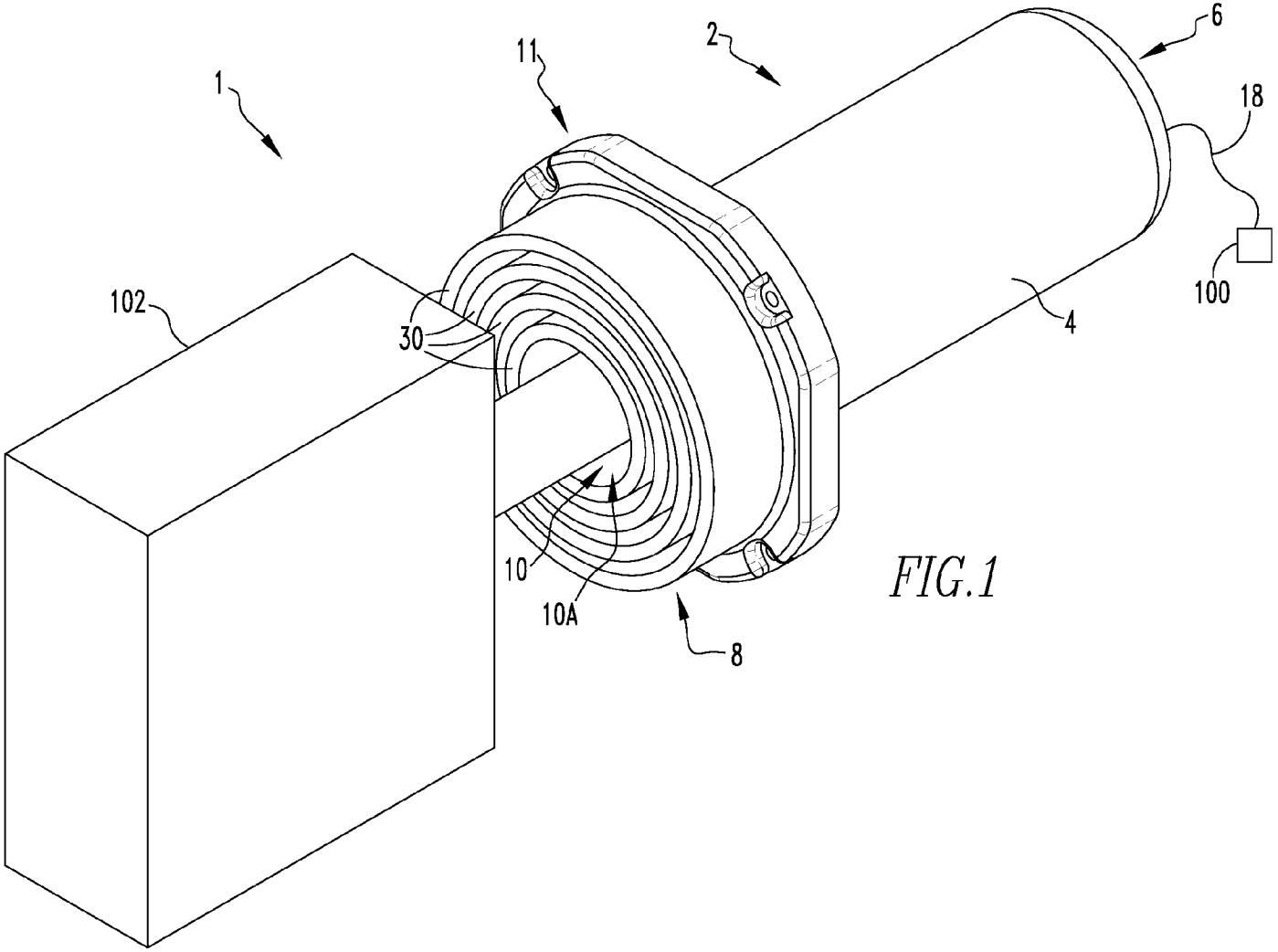
FIG. 1 is a partially schematic, isometric view of a system including an electrical disconnect in accordance with an embodiment of the disclosed concept.

Referring to FIG. 1, a system 1 including an electrical disconnect 2, is shown for selectively controlling the electrical connection between a voltage source 100 and device 102 (shown schematically, e.g., without limitation, a voltage transformer or a control power transformer). In examples of the disclosed concept, electrical disconnect 2 has been used to electrically connect auxiliary devices such as voltage transformers and control power transformers to voltage sources in the range of from about 1 kV to about 100 kV (i.e., medium voltage applications). It is to be appreciated, however, that electrical disconnect 2 may be used to electrically connect other devices without varying from the scope of the disclosed concept.

Figure 2:
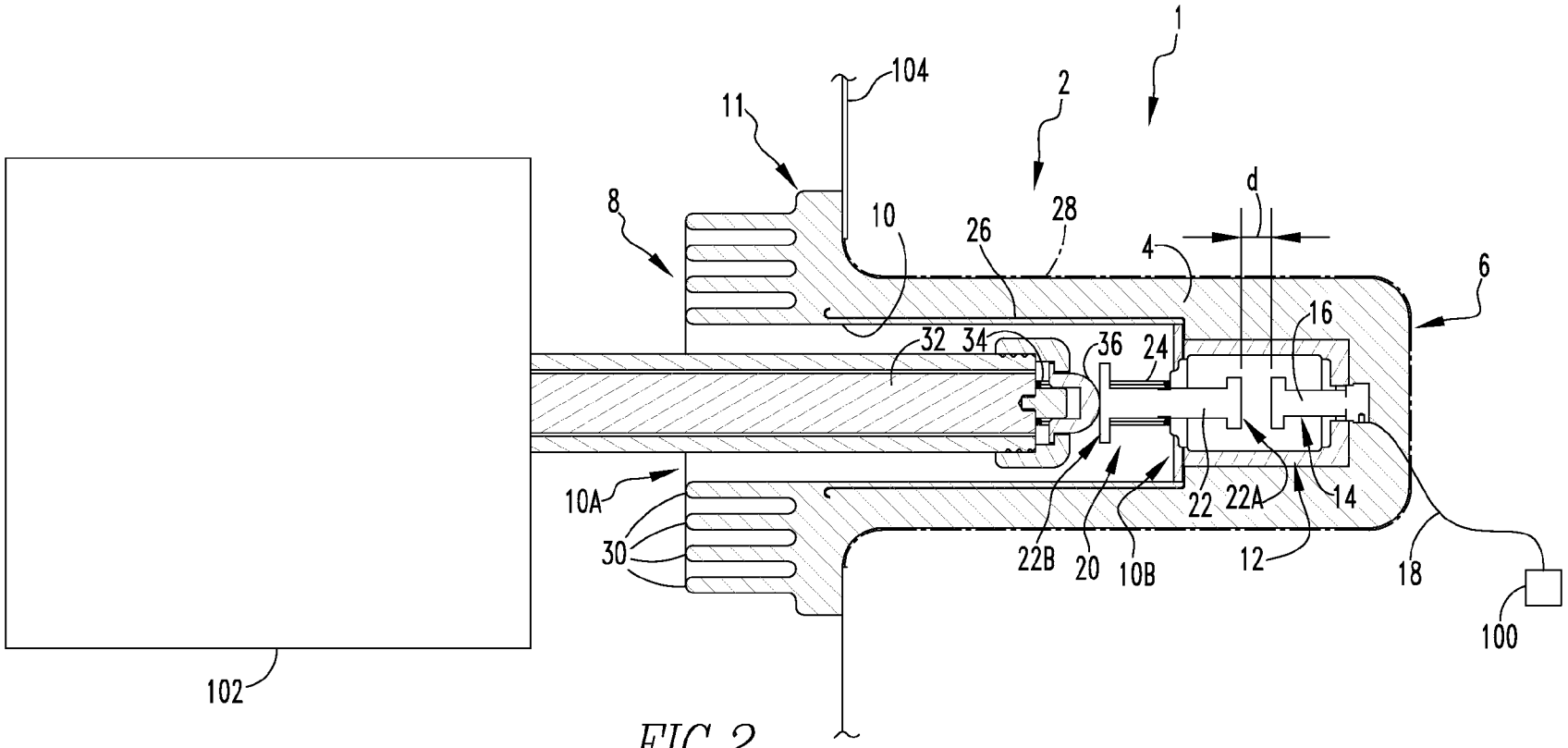
FIG. 2 is a partially schematic view of the system of FIG. 1 showing a cross-sectional view of the electrical disconnect disposed in an open position in accordance with an embodiment of the disclosed concept.
Figure 3:
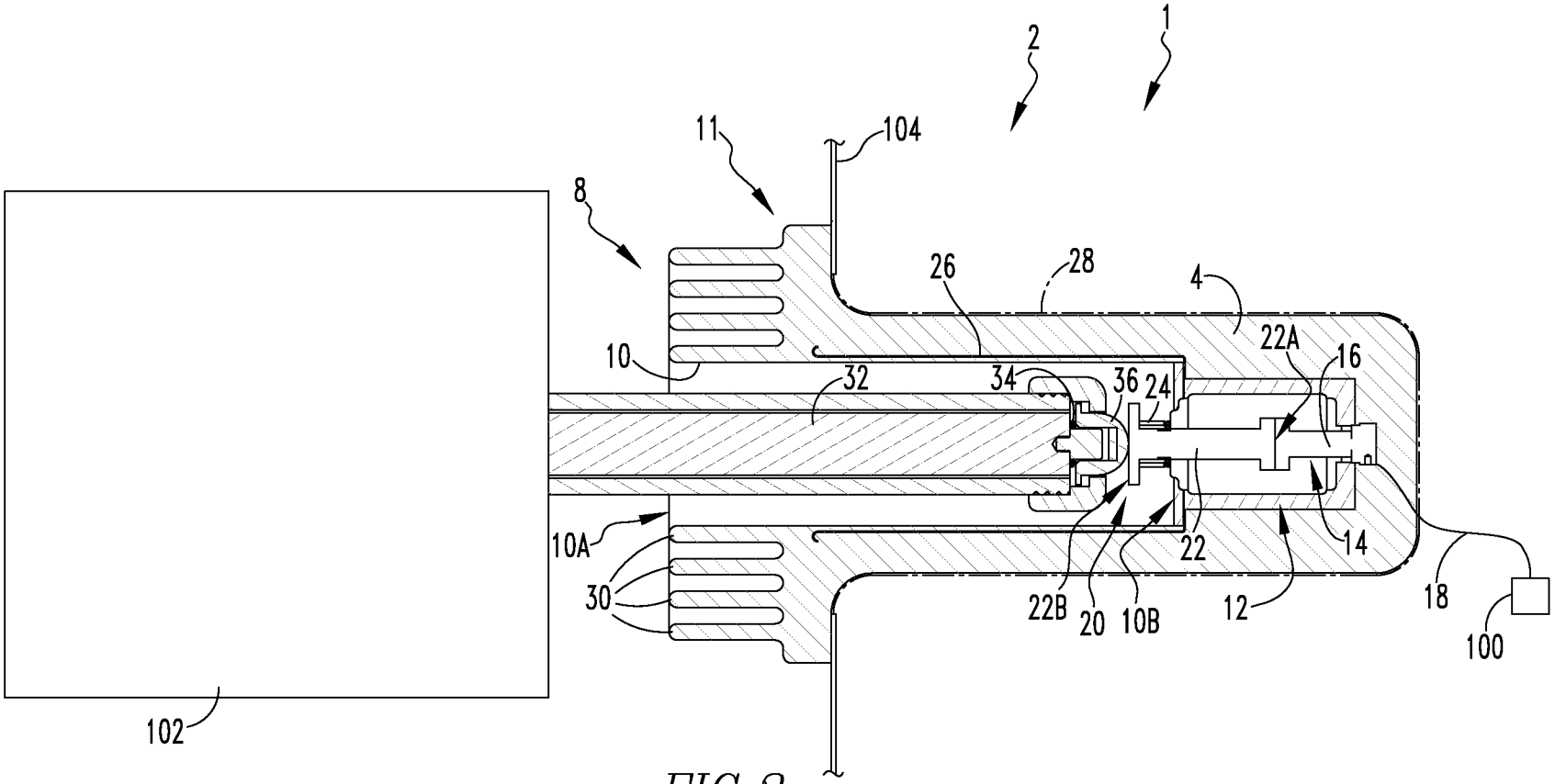
FIG. 3 is a partially schematic view of the system of FIG. 1 showing a cross-sectional view of the electrical disconnect disposed in a closed position in accordance with an embodiment of the disclosed concept.

As shown in FIGS. 2 and 3, the electrical disconnect 2 includes a housing 4 having a first end 6, an opposite second end 8 and a recess 10 defined therein. The recess 10 extends from an opening 10A disposed at or about the second end 8 of housing 4 toward a base 10B defined near the first end 6 of housing 4. The housing 4 is formed from a suitable non-conductive material such that housing 4 functions generally as an insulating tube. In an example embodiment of the disclosed concept the housing 4 is formed from an epoxy material, although other suitable materials (e.g., without limitation, glass polyester, porcelain, etc.) may be employed with varying from the scope of the disclosed concept. As generally shown in the side sectional views of FIGS. 2 and 3, the housing 4 may further include an outward extending flange portion 11 which may be used for securing the housing 4 to a panel member 104 of an electrical enclosure (e.g., without limitation, a switchgear cabinet).

Continuing to refer to FIGS. 2 and 3, the electrical disconnect 2 further includes a vacuum envelope 12 defined within the housing 4 generally about the first end 6 by a voltage insulating medium (e.g., without limitation, porcelain). A fixed contact assembly 14 having a fixed contact 16 is disposed at least partially within the vacuum envelope 12 and, as shown schematically in FIGS. 2 and 3, is electrically connected to the voltage source 100 via a high-voltage shielded cable 18 or other suitable connection. In the example embodiment illustrated in FIGS. 2 and 3, a conventional vacuum interrupter including a vacuum envelope defined by a porcelain housing was employed with the housing 4 over-molded thereon. It is to be appreciated, however, that other arrangements for providing a suitable vacuum envelope may be A movable contact assembly 20 is also disposed partially within the vacuum envelope 12, and partially in the recess 10 near the end 10B thereof, and includes a movable contact 22, having a first end 22A and a second end 22B, which is movable between an open position (such as shown in FIG. 2) in which the first end 22A of the movable contact 22 is spaced a separation distance d (FIG. 2) from the fixed contact 15 and a closed position (such as shown in FIG. 3) in which the first end 22A of the movable contact is in contact with the fixed contact 16. As a result of enclosing the contacts 16, 22 within a vacuum, the separation distance d needed to avoid partial discharge and arcflash is typically less than 1", depending on the voltage level. It is to be appreciated that such separation distance d is greatly reduced in comparison to convention solutions, such as previously discussed in the background section. Although not illustrated in the FIGS., it is to be appreciated that in use, movable contact 22, as well as components associated therewith, would be moved via a conventional racking mechanism or other suitable arrangement to selectively bring movable contact into, or out of, engagement with fixed contact 16.

In order to overcome the effects of atmospheric pressure acting on the movable contact 22 (as a result of the vacuum envelope 12), a biasing mechanism, such as coil spring 24 is employed to bias movable contact 22 toward the open position, away from the fixed contact 15.

In order to prevent partial discharge phenomena when the contacts 16, 22 are in any position, the electrical disconnect 2 may include one or more shields. In the example embodiment illustrated in the FIGS, electrical disconnect 2 includes a dynamic shield 26 disposed about the recess 10 within the housing 4 and extending from the base 10B toward the opening 10A thereof. More particularly, dynamic shield 26 is embedded within the wall which defines the recess 10 and is formed from a conductive mesh or other suitable material. Dynamic shield 26 is electrically connected to the movable contact 22 such that when the movable contact 22 is disposed in the closed position (i.e., in contact with the fixed contact assembly 14), voltage is applied to the dynamic shield 26. Such dynamic shield 26 acts generally as a Faraday Cage which serves to reduce partial discharge phenomena while the movable contact 22 is in the closed position as the auxiliary device passes through a barrier of ground potential. When the movable contact is in the open position, voltage is removed from the dynamic shield and it becomes a floating potential. At this time the auxiliary device is considered disconnected and therefore ground potential. If the dynamic shield was connected to the fixed contact end of the vacuum envelope then the dynamic shield would remain energized and a lot of partial discharge would be created between the shield and a conductor disposed within the recess 10 of housing 4.

In addition to the dynamic shield 26, electrical disconnect 2 further includes a ground shield 28 disposed on or near the outer periphery of the housing 4 which is electrically connected to the panel member 100. In the illustrated embodiment, ground shield 28 is formed from a conductive coating applied (e.g., without limitation, via spraying) to the outer surface of the housing 4. However, it is to be appreciated that ground shield 28 may be formed from other suitable materials or and/or via other suitable process without varying from the scope of the disclosed concept.

In order to provide a sufficient creepage distance from the exposed portion of the movable contact 22 to the panel member 104 while also minimizing size, housing 4 may include a number of cylindrical fins 30 extending from the second end 8 of the housing 4 about the opening 10A of the recess 10. Although four of such fins 30 are shown in the illustrated example, it is to be appreciated that one or more of the quantity, thickness or length of the fins 30 may be varied without varying from the scope of the disclosed concept.

In order to protect the device 102 from a current surge/fault, movable contact assembly 20 may further include a current limiting fuse 32 disposed between, and electrically connected with the second end 22B of movable contact 22 and the device 102. Fuse 32 is sized such that in the event of a surge/fault fuse 32 will blow before any damage is done to the device 102 or the electrical disconnect 2. By minimizing the let-through current, fuse 32 reduces the force required to hold the movable contact closed during fault conditions. Although shown as extending from the device 102 (shown schematically) it is to be appreciated device 102 may be mounted remotely from fuse 32 and electrically connected thereto via one or more intermediary elements (e.g., without limitation, wires) without varying from the scope of the disclosed concept. In the illustrated embodiment, fuse 32 includes a contact pressure spring 34 which biases a fuse contact 36 outward from fuse 32 toward movable contact 22. Such contact pressure spring 34 serves to account for any dimensional misalignment(s) while maintaining constant pressure for the fuse contact 36.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical disconnect comprising:

a housing having a first end and an opposite second end, the housing including a recess defined therein extending from an opening disposed at or about the second end of the housing toward a base defined near the first end of the housing;

a vacuum envelope defined within the housing about the first end;

a fixed contact assembly including a fixed contact disposed partially within the vacuum envelope, the fixed contact assembly structured to be in electrical communication with a voltage source; and a movable contact assembly including a movable contact having a first end disposed within the vacuum envelope and an opposite second end disposed in the recess near the base thereof, the movable contact being movable between a closed position in electrical contact with the fixed contact and an open position spaced apart from the fixed contact a separation distance, wherein the housing comprises a dynamic shield electrically connected to the movable contact, the dynamic shield being disposed about the recess within the housing and extending from the base toward the opening thereof, and wherein the housing further comprises a number of cylindrical fins disposed concentrically about the opening of the recess and extending from the second end of the housing.

2. The electrical disconnect of claim 1 wherein the separation distance is equal to or less than one inch.

3. The electrical disconnect of claim 1 wherein the housing is formed from an insulating material.

4. The electrical disconnect of claim 1 wherein the dynamic shield comprises a conductive mesh material disposed about the recess.

5. The electrical disconnect of claim 1 wherein the housing further comprises an outward extending flange, the flange being structured to couple the housing to a panel member.

6. The electrical disconnect of claim 1 wherein the housing further includes a ground shield disposed on or near the outer periphery thereof.

7. The electrical disconnect of claim 6 wherein the ground shield comprises a conductive coating disposed on the outer surface of the housing.

8. A system comprising:

a voltage source;

an electrical device; and an electrical disconnect as recited in claim 1.

9. The system of claim 8 wherein the separation distance is equal to or less than one inch.

10. The system of claim 8 wherein the voltage source provides a voltage in the range of from about 1 kV to about 100 kV.

11. The system of claim 8 wherein the dynamic shield comprises a conductive mesh material disposed about the recess.

12. The system of claim 8 wherein the housing further comprises an outward extending flange, the flange being structured to couple the housing to a panel member.

13. The system of claim 8 wherein the housing further includes a conductive coating disposed on the outer surface of the housing which is electrically connected to a ground.

14. An electrical disconnect comprising:

a housing having a first end and an opposite second end, the housing including a recess defined therein extending from an opening disposed at or about the second end of the housing toward a base defined near the first end of the housing;

a vacuum envelope defined within the housing about the first end;

a fixed contact assembly including a fixed contact disposed partially within the vacuum envelope, the fixed contact assembly structured to be in electrical communication with a voltage source; and a movable contact assembly including a movable contact having a first end disposed within the vacuum envelope and an opposite second end disposed in the recess near the base thereof, the movable contact being movable between a closed position in electrical contact with the fixed contact and an open position spaced apart from the fixed contact a separation distance, wherein the housing comprises a dynamic shield electrically connected to the movable contact, the dynamic shield being disposed about the recess within the housing and extending from the base toward the opening thereof, wherein the movable contact assembly comprises a current limiting fuse electrically connected to the second end of the movable contact, and wherein the current limiting fuse is electrically coupled to the second end of the movable contact via a fuse contact which is biased outward from the current limiting fuse and toward the second end by a contact pressure spring.

15. A system comprising:

a voltage source;

an electrical device; and an electrical disconnect as recited in claim 14, wherein the movable contact assembly comprises a current limiting fuse electrically connected to the second end of the movable contact, and wherein the current limiting fuse is electrically coupled to the second end of the movable contact via a fuse contact which is biased outward from the current limiting fuse and toward the second end by a contact pressure spring.

16. The electrical disconnect of claim 14 wherein the separation distance is equal to or less than one inch.

17. The electrical disconnect of claim 14 wherein the housing is formed from an insulating material.

18. The electrical disconnect of claim 14 wherein the dynamic shield comprises a conductive mesh material disposed about the recess.

19. The electrical disconnect of claim 14 wherein the housing further comprises an outward extending flange structured to couple the housing to a panel member.

* * * * *